United States Patent [19]

Fleming

[11] 3,955,156

[45] May 4, 1976

[54] MICROWAVE POWER DIVIDER AND MAGIC TEE EACH COMPRISING COPLANAR AND SLOT TRANSMISSION LINES

[75] Inventor: Paul Lawrence Fleming, Rockville, Md.

[73] Assignee: Communications Satellite Corporation, Washington, D.C.

[22] Filed: Apr. 29, 1974

[21] Appl. No.: 465,057

[52] U.S. Cl. ..... 333/9; 333/11; 333/84 R; 333/84 M

[51] Int. Cl.[2] ..... H01P 5/10; H01P 5/20

[58] Field of Search ..... 333/6, 9, 11, 84 R, 333/84 M; 325/445, 446

[56] References Cited

UNITED STATES PATENTS

| | | | |
|---|---|---|---|
| 2,836,798 | 5/1958 | Le Vine | 333/84 M X |
| 3,530,407 | 9/1970 | Blight | 333/84 M X |
| 3,735,267 | 5/1973 | Napoli | 325/446 |
| 3,886,500 | 5/1975 | Baril et al. | 333/11 |

*Primary Examiner*—Paul L. Gensler

*Attorney, Agent, or Firm*—Sughrue, Rothwell, Mion, Zinn & Macpeak

[57] ABSTRACT

A planar microwave integrated circuit, including features of slot lines and coplanar lines, for use as a magic tee and a power divider.

5 Claims, 5 Drawing Figures

FIG. 1
PRIOR ART
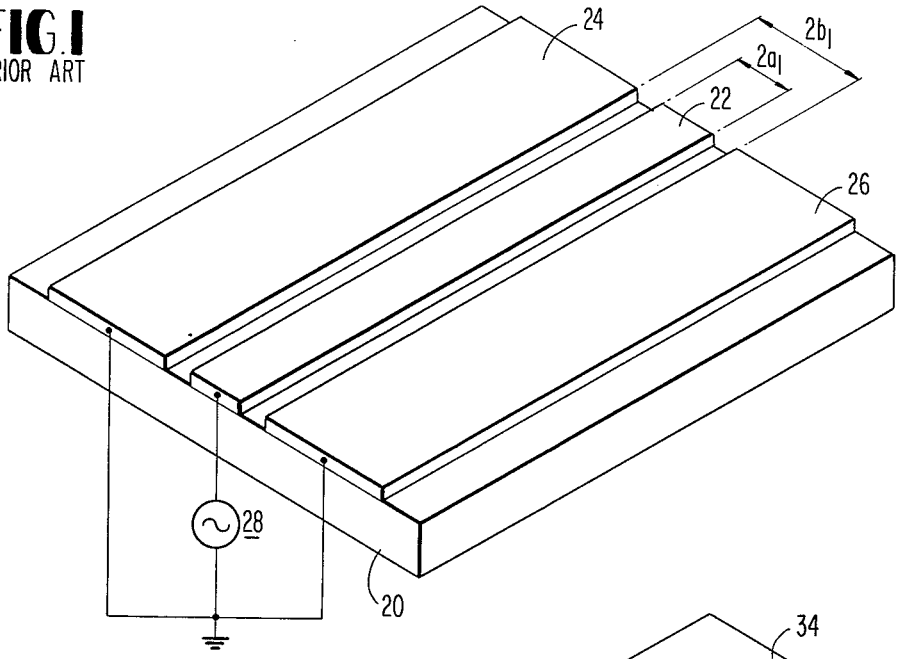
FIG. 2
PRIOR ART
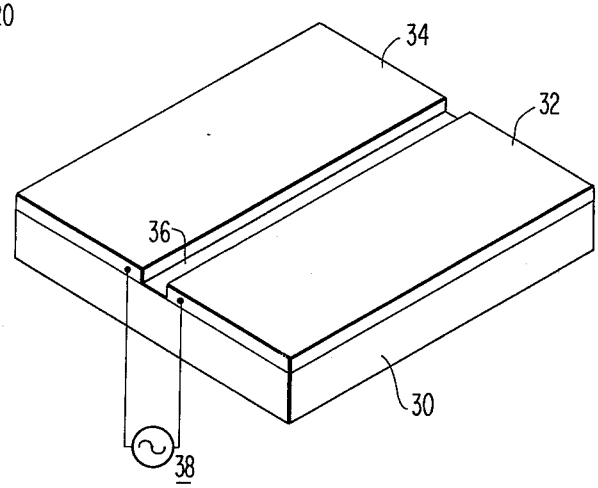
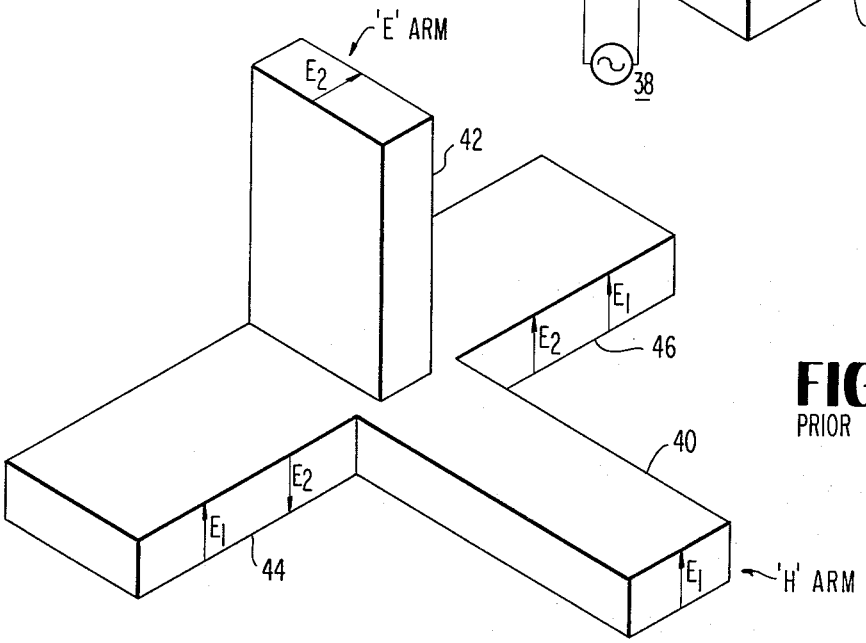
FIG. 3
PRIOR ART

MICROWAVE POWER DIVIDER AND MAGIC TEE EACH COMPRISING COPLANAR AND SLOT TRANSMISSION LINES

BACKGROUND OF THE INVENTION

The invention is in the field of microwave integrated circuits and in particular is a microwave magic tee and power splitter combining coplanar waveguide and slot line waveguide technology.

A technology generally known as microwave integerated circuitry has been developed and used to provide microwave circuits which can replace and are easier to fabricate then conventional microwave devices such as rectangular waveguide and coaxial transmission lines. The microwave integrated technology includes such devices as the microstrip transmission line, the coplanar transmission line and the slot line transmission line.

The microstrip transmission line basically comprises a thin conductor on one surface of a dielectric substrate and a ground plane conductor on the opposite side. The top surface conductor is patterned to result in a microwave device of specific applications. The pattern can be easily formed by printed circuit techniques.

Another type of integrated microwave circuit is the coplanar waveguide, which is described in an article by Cheng P. Wen, entitled "Coplanar Waveguide: A Surface Strip Transmission Line Suitable For Non-reciprocal Gyromagnetic Devices Applications," IEEE Transactions on Microwave Theory and Techniques, Vol. MTT-17, No. 12, Dec. 1969.

A coplanar waveguide consists of a thin conductor on a dielectric substrate with two parallel coplanar ground conductors on opposite sides of said thin conductor. A coplanar waveguide is illustrated in FIG. 1. One advantage of the coplanar waveguide over the microstrip waveguides is that the ground plane is coplanar. Thus, in a microstrip waveguide, where the ground plane is on the opposite side of the dielectric substrate, the ground plane is not easily accessible for shunt connections necessary for many active microwave devices. Another advantage of coplanar waveguides is that they are suitable for many non-reciprocal magnetic device functions. The latter type functions require circularly polarized RF magnetic fields for their operation, and present microstrip and strip lines do not provide such fields. However, as pointed out in the Wen article the coplanar waveguide results in a magnetic field at the air-dielectric interface that is nearly circularly polarized. The propagation mode of the coplanar waveguide is quasi-TEM mode, i.e., the electric and magnetic field vectors are transverse to the direction of propagation.

In FIG. 1, the coplanar waveguide comprises center conductor 22 and ground planes 24, 26 on the surface of dielectric substrate 20. The application of a signal is indicated generally at 28. The impedance of such a device is a function of the ratio $a_1/b_1$, where $2a_1$ is the width of the center strip and $2b_1$ is the distance between the two ground electrodes.

Another type of microwave integrated circuit device is the slot line, a basic example of which is shown in FIG. 2. The slot line consists of a slot or gap 36 in a conductive coating 32, 34 on a dielectric substrate 30. The application of a signal is indicated generally at 38. In a slot line there is a voltage difference between the slot edges. The electric field extends across the slot and the magnetic field is perpendicular to the slot. Because the voltage occurs across the slot, the configuration is especially convenient for connecting shunt elements such as diodes, resistors and capacitors. The various characteristics of a slot line are described in an article by Seymour B. Cohn, entitled "Slot LIne on a Dielectric Substrate," IEEE Transactions on Microwave Theory and Techniques, Vol. MTT-17, No. 10, Oct. 1969. The propagation mode in a slot line is TE mode, i.e., the E field, but not necessarily the H field, is transverse to the direction of propagation. A slot line can also be fabricated by printed circuit techniques.

Despite the advent of microwave integrated circuits, one of the most useful microwave devices, —the magic tee—has heretofore not been constructed using only two dimensional construction features such as are present in the coplanar or slot line technology. An example of a typical magic tee is illustrated in FIG. 3. It consists of four rectangular waveguides, generally referred to as the input H-arm 40, the input E-arm 42, and the colinear output arms 44 and 46, all meeting at the junction. As is well known an input microwave signal having vector $E_1$ applied to the H-arm port as shown, will travel to the junction and split into in-phase vectors $E_1$ and appear at the ports of output arms 44 and 46. A microwave signal having vector $E_2$ applied at the port of E-arm 42 will also travel toward junction 42, but will split into out-of-phase vectors $E_2$ as shown in colinear output arms 44 and 46. For in-phase input signals all of the power will appear at the output port of arms 46, whereas for out-of-phase input signals all of the output power will appear at the output port of arm 44. The device generally operates as a power adder and subtractor. The signal band over which the magic tee will properly operate is dependent upon the dimensions of the rectangular waveguides. Equivalent structures fabricated in coaxial and strip transmission line have the three dimensional construction feature.

SUMMARY OF THE INVENTION

It is an object of the invention to provide a magic tee which can be constructed using planar printed circuit technology by masking and etching a single surface on a microwave integrated circuit substrate.

This and other objects of the invention are achieved by providing a structure which combines a slot line series tee with a novel coplanar line shunt tee, the latter being a coplanar-to-slot line power divider. The slot line series tee comprises a planar conductor having slots therein in the shape of a T. An input signal applied across the slot forming the base of the tee splits in out-of-phase relation and travels down the slots forming the output arms of the tee. The coplanar-to-slot line power divider consists of a coplanar line which is designed such that the center conductor and the space between ground conductors widen substantially with distance from the coplanar input port. The two spacings between the center conductor and the respective ground planes become widely separated and intersect, respectively, the output arms of the slot line series tee.

BRIEF DESCRIPTION OF THE DRAWINGS

FIG. 1 is a perspective view of a prior art coplanar transmission line.

FIG. 2 is a perspective view of a prior art slot line transmission line.

FIG. 3 is a perspective view of a prior art rectangular wave-guide magic tee.

DETAILED DESCRIPTION OF THE PREFERRED EMBODIMENTS

Figure 4:
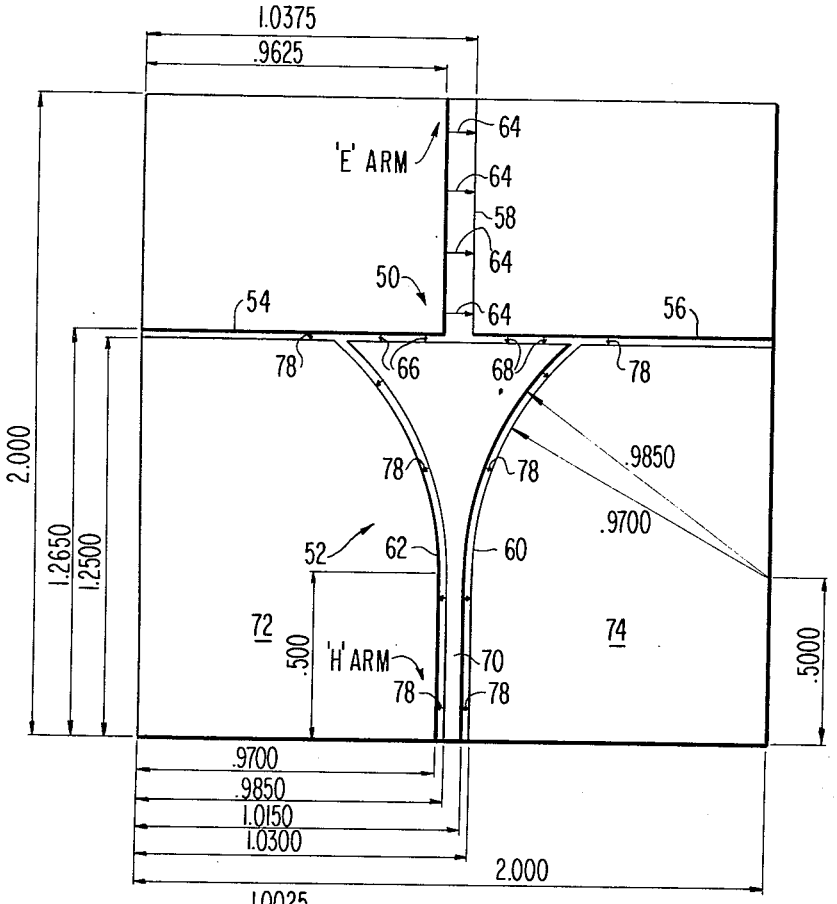
FIG. 4 is a top view of a preferred embodiment of a planar magic tee.

A top view of a preferred embodiment of the invention is illustrated in FIG. 4 and consists basically of a slot line series tee 50 and a coplanar shunt tee 52. The slot line series tee 50 is known in the art whereas the coplanar shunt tee 52 is novel and represents a subcombination invention of the magic tee of FIG. 4.

The device of FIG. 4 physically consists of a metal conductor overlying a dielectric substrate. There are several openings in the metal, shown at 54–62, exposing the upper surface of the dielectric and forming slots. Slots 54, 56 and 58 form a slot line series tee 50. An input signal applied across slot 58 in a known manner will have an E-vector represented by arrows 64. The signal will split at the junction resulting in power entering both slots 56 and 54. The signal in arm 54, as represented by E-vector arrows 66, will be out-of-phase with the signal in arm 56, as represented by E-vector arrows 68.

The coplanar shunt tee comprises center conductor 70 and ground conductors 72 and 74. A signal applied at the input port of the coplanar shunt tee is represented by E field vector arrows 78. As seen in the drawings the E field vectors in the respective apertures of the coplanar line remain in-phase as the center conductor 70 widens substantially and the apertures 60 and 62 intersect slots 54 and 56. Thus, as can be seen the signal relationship in the four arms of the planar device of FIG. 4 is the same as the signal relationship in the four arms of the rectangular waveguide in FIG. 3. The signal power will add in one output arm and will subtract in the other output arm.

Figure 5:
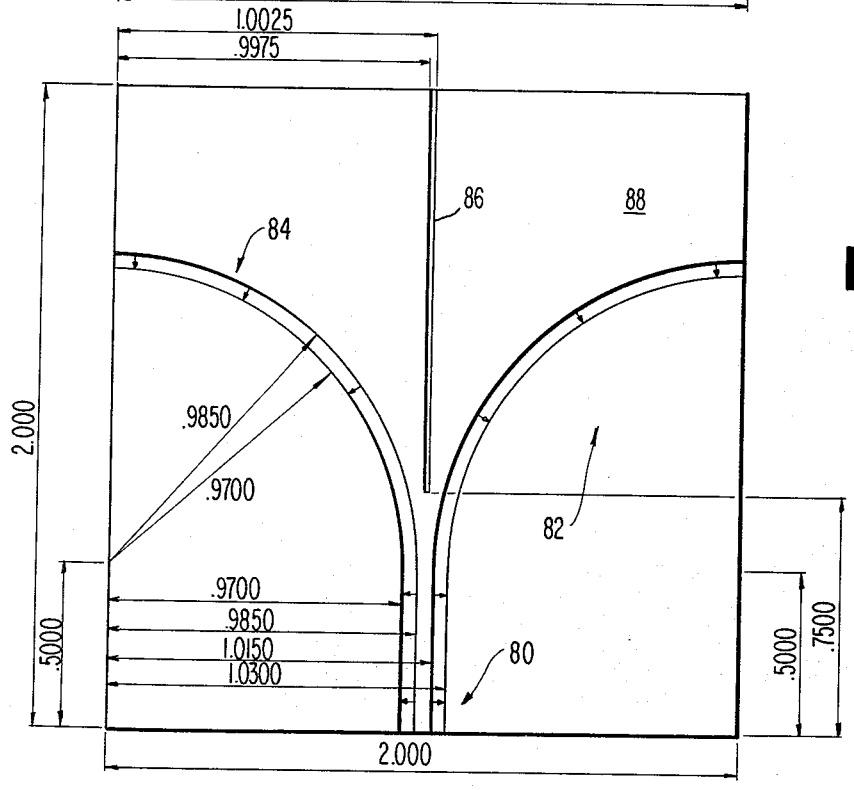
FIG. 5 is a top view of a preferred embodiment of a planar power divider.

The shunt tee may be used alone as a power divider. An example of the latter device is shown in FIG. 5. The power divider or shunt tee, as it is called, has characteristics of a coplanar line at the input end 80 and characteristics of a slot line at the output ends 82, 84. In an example of the device constructed and tested the input end transmission line impedance was 50 Ω. This was determined in a known manner and is dependent upon $a_1/b_1$, as described above in the background section. The propagation mode at the input is in the TEM mode. As the center conductor widens and $a_1/b_1$ approaches unity, this presents a very low transmission line impedance to the TEM mode propagation. Ordinarily, the low impedance would result in substantial reflection, but the device acts as a slot line as the center conductor spreads and the mode of propagation changes to the TE mode. The dimensions shown in FIGS. 4 and 5 are in inches and the devices constructed according to those dimensions are particularly suitable over the 4–6 GHz bandwidth. Alteration of the dimensions to suit other bandwidths is within the skill of the art. The device of FIG. 5 was tested with 50 ohm loads connected to the output slot arms. There was a power reflection of less than 8% at the input over the range of 2.0 to 6.0 GHz.

The planar magic tee of FIG. 4 was also built and tested and was found to have high isolation between the two input arms. The isolation between input arms over the range of 3.7 to 8.3 GHz was better than 25 dB. The power split in the coplanar input arm was uniform up to about 6.0 GHz at the −4.5 dB level, including losses. The slot line input arm power split was uniform over a narrower band. In order to improve isolation between the output arms 82 and 84, of the shunt tee of FIG. 5, an additional slot 86 may be placed in the center conductor 88. This slot 86 increases the isolation of the output arms 82 and 84 by interrupting the ground plane current which flows in the center conductor 88.

Since the devices of FIGS. 4 and 5 have the metallic pattern on a single surface they can be constructed entirely by printed circuit technology.

What is clamed is:

1. A magic tee consisting of a dielectric substrate and film of conductive material covering substantially all of one surface of said substrate, said film having openings therein forming both a slot line series tee having a first input arm and first and second output arms and a coplanar-to-slot line shunt tee having a second input arm and comprising a first portion formed of coplanar transmission line and a second portion formed of two slot line transmission lines, said two slot line transmission lines cooperating with said first and second output arms thereby forming four arms of the magic tee, the openings forming said four arms communicating with one another.

2. A magic tee as claimed in claim 1 wherein said film is a metal film.

3. A magic tee as claimed in claim 2 wherein the openings forming said slot line series tee having said first input arm and said first and second output arms are in the pattern of a T-shaped opening, the leg of the T-shaped opening serving as an input arm of the magic tee, and the head of the T-shaped opening serving as the two output arms, one on each side of the junction between the head and the leg, whereby a signal, applied to the input arm to cause an electric field between the thin film portions on opposite edges of the input arm opening, travels to said junction and splits into out-of-phase signals travelling in the respective output arms.

4. A magic tee as claimed in claim 3 wherein said first portion of said coplanar-to-slot line shunt tee having a second input arm cooperating with said first and second output arms comprises two slot openings extending from an input point on said substrate on the side of said T-shaped opening opposite the leg of said T, said two slot openings being substantially parallel near said second input arm and said two slot openings gradually fanning out in said second portion prior to communication with said output arms to cause a signal applied at said input of said second input arm to propagate in the TEM mode in said parallel first portion of the arm and to change to the TE mode as said arms fan out substantially and terminate respectively in communication with said output arms.

5. A microwave power divider consisting of a dielectric substrate and a metal film having openings therein covering substantially all of one surface of said substrate, said openings defining a coplanar transmission line input segment of the type including a center conductor and two ground conductors on opposite sides thereof and two slots gradually arcuately fanning out to form outputs at opposite edges of said substrate said outputs having the characteristics of slots line transmission lines and said openings further defining a third slot located substantially equidistant between said outputs for electrically isolating said outputs, whereby a signal applied at said input propagates in the TEM mode and gradually changes to the TE mode as said two slots gradually arcuately fan out.

* * * * *